US009492046B2

(12) United States Patent
Cole et al.

(10) Patent No.: US 9,492,046 B2
(45) Date of Patent: Nov. 15, 2016

(54) VACUUM CLEANER TOOL

(71) Applicant: Dyson Technology Limited, Wiltshire (GB)

(72) Inventors: Samuel Steven Cole, Swindon (GB); Matthew Adam Tucker, Bristol (GB); Sean Ventress, Bristol (GB); James Dyson, Bristol (GB)

(73) Assignee: Dyson Technology Limited, Wiltshire (GB)

( * ) Notice: Subject to any disclaimer, the term of this patent is extended or adjusted under 35 U.S.C. 154(b) by 0 days.

(21) Appl. No.: 14/618,607

(22) Filed: Feb. 10, 2015

(65) Prior Publication Data

US 2015/0223655 A1 Aug. 13, 2015

(30) Foreign Application Priority Data

Feb. 10, 2014 (GB) ..... 1402268.5

(51) Int. Cl.
*A47L 9/02* (2006.01)
*A47L 9/06* (2006.01)

(52) U.S. Cl.
CPC ..... *A47L 9/0606* (2013.01); *A47L 9/068* (2013.01); *A47L 9/0693* (2013.01)

(58) Field of Classification Search
CPC .... A47L 9/0606; A47L 9/068; A47L 9/0693
USPC ..... 15/415.1, 416
IPC ..... A47L 9/02
See application file for complete search history.

(56) References Cited

U.S. PATENT DOCUMENTS

| | | | | |
|---|---|---|---|---|
| 2,276,943 | A | 3/1942 | Dow | |
| 2,824,334 | A | 2/1958 | Laningham | |
| 4,023,234 | A * | 5/1977 | Martinec et al. | 15/331 |
| 5,502,870 | A | 4/1996 | Ragner et al. | |
| 5,533,230 | A | 7/1996 | Rouda | |
| 8,402,603 | B1 | 3/2013 | Meek | |
| 2013/0319469 | A1 | 12/2013 | Borges, Sr. et al. | |
| 2015/0223656 | A1 | 8/2015 | Tucker et al. | |

FOREIGN PATENT DOCUMENTS

| | | |
|---|---|---|
| CN | 202386624 | 8/2012 |
| DE | 10 2008 021 353 | 11/2009 |
| EP | 0 377 801 | 7/1990 |
| GB | 1071858 | 6/1967 |
| GB | 2 364 499 | 1/2002 |

(Continued)

OTHER PUBLICATIONS

Search Report dated Jun. 27, 2014, directed to GB Application No. 1402268.5; 2 pages.

(Continued)

*Primary Examiner* — David Redding
(74) *Attorney, Agent, or Firm* — Morrison & Foerster LLP

(57) ABSTRACT

A tool for a vacuum cleaner comprising a duct for attachment to a wand, hose or the like of the vacuum cleaner, a nozzle and one of more dirt-sweeping elements. The dirt-sweeping elements are secured to a base of the nozzle and are arranged into at least two chevrons oriented in opposite directions towards the sides of the nozzle. At least two suction openings are then provided in the base of the nozzle, each suction opening being located within a chevron.

30 Claims, 4 Drawing Sheets

(56) References Cited

FOREIGN PATENT DOCUMENTS

| | | |
|---|---|---|
| JP | 64-40352 | 3/1989 |
| JP | 2-59754 | 5/1990 |
| JP | 9-327423 | 12/1997 |
| JP | 2001-8866 | 1/2001 |
| JP | 2002-165732 | 6/2002 |
| JP | 2003-93283 | 4/2003 |
| JP | 2010-166995 | 8/2010 |
| WO | WO-84/03429 | 9/1984 |
| WO | WO-2009/133031 | 11/2009 |

OTHER PUBLICATIONS

International Search Report and Written Opinion mailed Apr. 7, 2015, directed to International Application No. PCT/GB2015/050233; 10 pages.
Tucker et al., Office Action mailed Aug. 14, 2015, directed to U.S. Appl. No. 14/618,691; 6 pages.
Search Report dated Jun. 6, 2016, directed to GB Application No. 1605395.1; 1 page.

* cited by examiner

VACUUM CLEANER TOOL

REFERENCE TO RELATED APPLICATION

This application claims priority of United Kingdom Application No. 1402268.5, filed Feb. 10, 2014, the entire contents of which are incorporated herein by reference.

FIELD OF THE INVENTION

The present invention relates to a tool for a vacuum cleaner.

BACKGROUND OF THE INVENTION

Vacuum cleaners often include a number of different tools for performing particular tasks. A tool may be provided that is intended to be swept from side to side across the cleaning surface. However, the pickup performance of such tools is often poor.

SUMMARY OF THE INVENTION

The present invention provides a tool for a vacuum cleaner comprising a duct for attachment to a wand, hose or the like of the vacuum cleaner, a nozzle and one of more dirt-sweeping elements, wherein the dirt-sweeping elements are secured to a base of the nozzle and are arranged into at least two chevrons oriented in opposite directions towards the sides of the nozzle, and suction openings are provided in the base of the nozzle, each suction opening being located within a chevron.

The tool is intended to be swept from side to side with the base facing the cleaning surface. As the tool is swept sideways, dirt in the immediate path of the suction openings is drawn into the interior of the nozzle, and from there the dirt is carried to the vacuum cleaner via the duct. Dirt passing on either side of a suction opening is collected by the dirt-sweeping elements. Fine dirt is typically help by the dirt-sweeping elements until such time as the dirt is drawn into one of the suction openings, e.g. when the tool is lifted, when the direction of travel is reversed, or should the user invert the tool and agitate the dirt-sweeping elements. Coarse or relatively heavy dirt, on the other hand, is typically guided by the dirt-sweeping elements, by virtue of their chevron shape, towards the suction openings. By providing at least two chevrons that are oriented in opposite directions, dirt is picked up when sweeping the tool in both directions.

Each dirt-sweeping element may form a continuous curtain, i.e. there are no gaps in or through each dirt-sweeping element. This then has the advantage of creating a region of relatively low pressure within each chevron, which in turn leads to relatively high speeds for the airflow drawn into the suction opening. As a result, dirt is better entrained by the airflow and carried to the suction opening. By contrast, if the dirt-sweeping elements were discontinuous, the pressure within each chevron would increase, the speed of the airflow would then decrease, and thus less dirt would be entrained by the airflow.

As the size of each suction opening increases, the suction at each opening decreases. As a result, the tool will fail to pick up heavier dirt. Additionally, as the size of the suction openings increases, the suction over the length of the nozzle is less well balanced. For example, if the duct is attached to the rear of the nozzle then suction will be greatest at the rearmost suction opening. As the suction openings increase in size, more air is pulled in through the rearmost suction opening and thus less of the available suction power is provided at the foremost suction opening. As a result, dirt pickup at the front of the tool will worsen. Accordingly, for these reasons, the area of each suction opening may be no more than 20% of the area delimited by a respective chevron.

If the suction openings are located immediately adjacent the dirt-sweeping elements then the suction generated at the openings may cause the dirt-sweeping elements to be drawn into and restrict the suction openings. In order to avoid this from happening or at least reduce the likelihood of it occurring, each suction opening may be spaced from the dirt-sweeping elements. As a result, the suction experienced by the dirt-sweeping elements is reduced. Should the dirt-sweeping elements comprise bristles, each suction opening may be spaced from the dirt-sweeping elements by at least a distance corresponding to the length of the bristles. Consequently, even if the bristles are drawn towards the suction openings, the bristles do not restrict the suction openings. This has the further advantage that relatively soft bristles may be used, which are less likely to mark the cleaning surface. Soft bristles are likely to be crushed between the nozzle and the cleaning surface during normal use. However, by ensuring that the suction openings are spaced from the bristles by at least a distance that corresponds to the lengths of the bristles, the crushed bristles do not restrict the suction openings.

Each of the suction openings may be triangular in shape. This then has the advantage that each suction opening may be located towards the apex of a respective chevron whilst ensuring that the suction opening is spaced evenly from the dirt-sweeping elements.

One or more further suction openings may be provided in at least one side of the nozzle. This then has at least two advantages. First, should dirt block one of the suction openings in the base of the nozzle, the further suction openings may help unblock the opening be providing an airflow within the interior of the nozzle that agitates and helps dislodge the trapped dirt. Second, the tool may be rotated through 90 degrees and used on its side.

One or more further suction openings may be provided at an edge of the nozzle between the base and a side of the nozzle such that each further suction opening is provided partly in the base and partly in the side of the nozzle. As noted in the preceding paragraph, further suction openings help to unblock suction openings in the base of the nozzle. Additionally, by providing further suction openings that are provided in a side of the nozzle, the tool may be rotated through 90 degrees and used on its side. When used on its side, dirt could conceivably block the side part of the further suction opening. However, since the further opening spans the base and the side of the nozzle, there continues to be a flow of air through the base part of the further suction opening. This airflow then helps to agitate and dislodge the dirt from the side part. Equally, when sweeping the base of the tool over the cleaning surface, should dirt block the base part of the further suction opening, the flow of air through the side part helps to agitate and dislodge the dirt.

As noted in the previous two paragraphs, one or more further suction openings may be provided in a side the nozzle. Moreover, each suction opening may have a respective further suction opening. That is to say that, for each suction opening in the base of the nozzle, there is one further suction opening only provided in a side of the nozzle. This then has the advantage that the further suction openings help to unblock the suction openings in the base of the nozzle, without adversely affecting the suction at the suction openings.

The front of the nozzle may be chamfered. When cleaning along an edge, such as that between a floor and a wall, the chamfered front of the nozzle may be brought into contact with the wall. The tool may then be pushed in a generally forwards direction. Owing to the chamfer in the nozzle, the push force causes the tool to slide sideways along the floor whilst maintaining contact with the wall. As a result, cleaning along the edge is made easier in comparison to, say, a square front. For example, if the front of the nozzle were square, a user would be required to pull the tool sideways whilst simultaneously pushing the tool forwards against the wall. As a result, moving the tool along the wall is likely to feel more laboured. Additionally, the tool is more likely to move in fits and starts.

The front of the nozzle may comprise a chamfered section and a further section. The chamfered section may then be closed and a suction opening may be provided in the further section. When cleaning along an edge, such as that between a floor and a wall, the chamfered section may be brought into contact with the wall. The tool may then be pushed in a generally forwards direction, causing the tool to slide sideways along the floor whilst maintaining contact with the wall. Since the tool contacts the wall along the chamfered section, the further section is spaced from the wall. As a result, a gap is created between the suction opening in the front of the nozzle and the wall. This then ensures that a relatively good flow of air is drawn along the edge and into the suction opening, resulting in good pickup of dirt along the edge.

The height of the nozzle may be smaller than both the width and length of the nozzle. As a result, the nozzle may be configured such that the height permits cleaning below or behind items having a relatively small clearance whilst the width and length provide a relatively large area for sweeping across the cleaning surface.

The duct may extend rearwards from the nozzle along an axis parallel to the base of the nozzle. Additionally or alternatively, the height of the duct may be smaller than the width of the duct. For example, the duct may have a rectangular or oval-shaped cross-section. These features then have the advantage of maintaining a relatively low height for the tool. As a result, the tool may be used to clean beneath or behind items having a relatively small clearance. In particular, the tool as a whole may be pushed beneath or behind such items.

BRIEF DESCRIPTION OF THE DRAWINGS

In order that the present invention may be more readily understood, embodiments of the invention will now be described, by way of example, with reference to the accompanying drawings, in which.

DETAILED DESCRIPTION OF THE INVENTION

Figure 1:
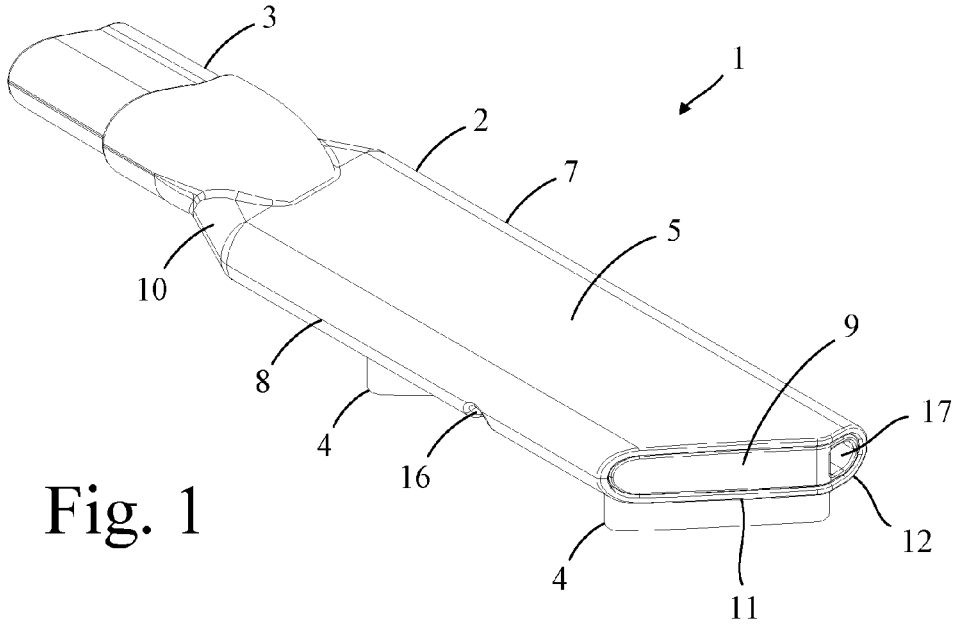
FIG. 1 is a first axonometric view of a tool in accordance with the present invention, the view illustrating the top, the front and a side of the tool.
Figure 2:
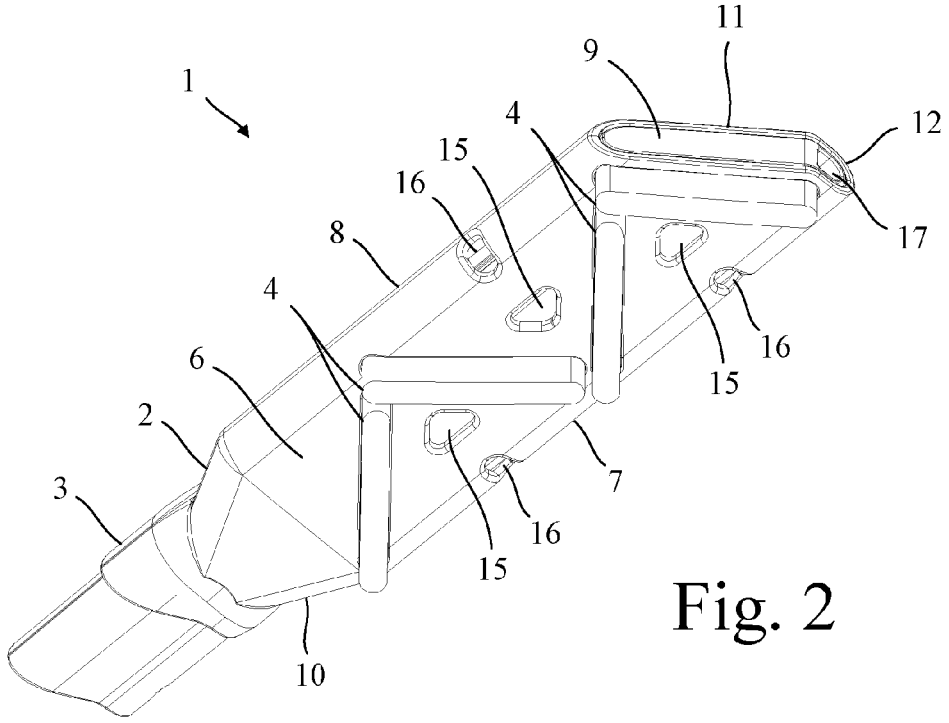
FIG. 2 is a second axonometric view of the tool, the view illustrating the bottom, the front and the side of the tool.
Figure 3:
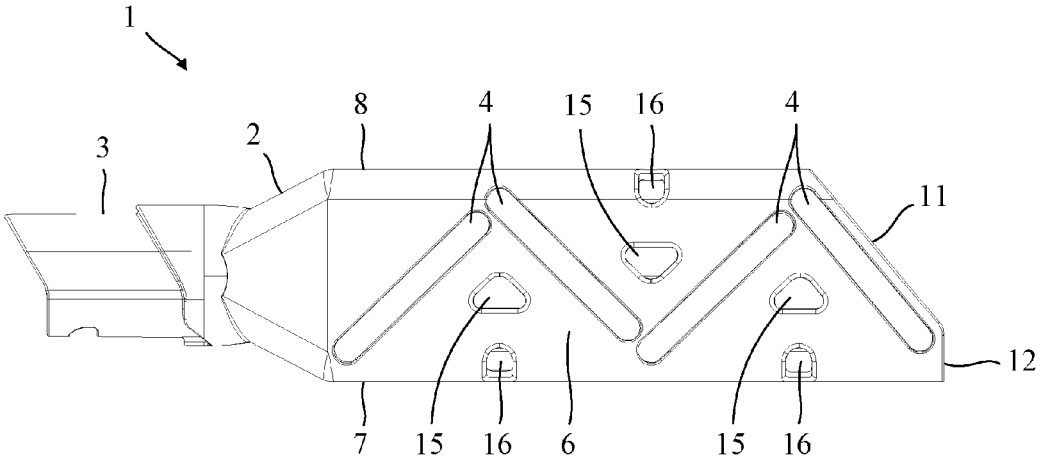
FIG. 3 is a bottom view of the tool.
Figure 4:
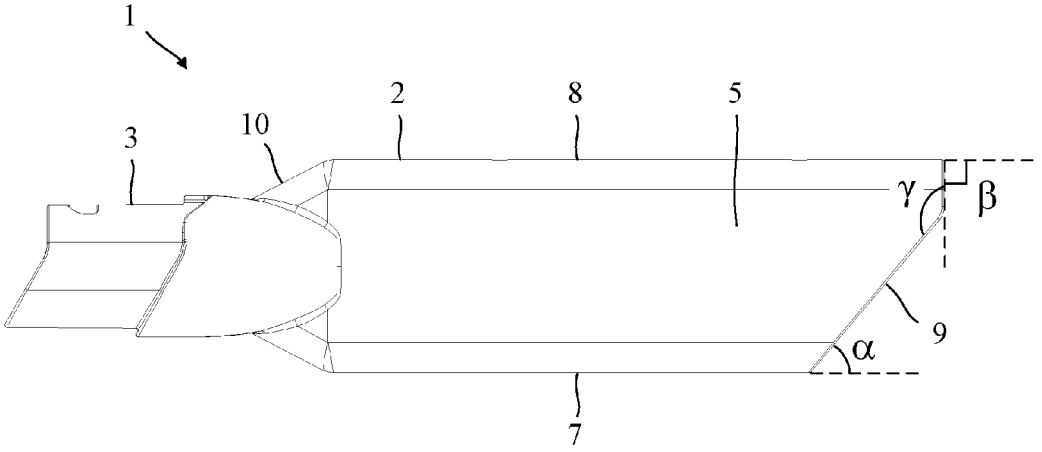
FIG. 4 is a top view of the tool.

The vacuum cleaner tool 1 of FIGS. 1 to 4 comprises a nozzle 2, a connecting duct 3, and a plurality of dirt-sweeping elements 4.

The nozzle 2 is a relatively flat hollow structure, with the height of the nozzle being smaller than both the length and width. The top 5 and base 6 of the nozzle 2 are flat. The sides 7,8 of the nozzle 2 are curved and extend parallel to one another between the front 9 and rear 10 of the nozzle 2. The front 9 of the nozzle 2 is chamfered and comprises a chamfered section 11 and a non-chamfered section 12, the chamfered 11 section being longer than the non-chamfered section 12. The rear 10 of the nozzle 2 tapers towards the connecting duct 3, which attaches to the rear 10 of the nozzle 2.

A plurality of suction openings 15,16 are provided in the base 6 of the nozzle 2. Additionally, a single suction opening 17 is provided in the non-chamfered section 12 of the front 9 of the nozzle 2. The suction openings 15,16 in the base 6 comprise two different types. Suction openings of a first type 15 are roughly triangular in shape and are located towards the longitudinal centre of the base 6. Suction openings of a second type 16 are elliptical in shape, with each resembling an elongate oval. These suction openings 16 are located at the edges of the nozzle 2 such that each suction opening 16 is provided partly in the base 6 and partly in a side 7,8 of the nozzle 2. In order to better distinguish the two types of suction opening, the first type of suction opening 15 will hereafter be referred to as a central suction opening and the second type of suction opening 16 will be referred to as an edge suction opening. In the embodiment illustrated in the Figures, there are three central suction openings 15 and three edge suction openings 16.

The connecting duct 3 is attached to the rear 10 of the nozzle 2 and extends along a longitudinal axis that is parallel to the top 5 and base 6 of the nozzle 2. Additionally, the connecting duct 3 is flattened vertically such that the cross-sectional shape of the duct 3 is oval rather than circular. The connecting duct 3 is intended to be attached to a hose, wand or the like of a vacuum cleaner (not shown) and is in fluid communication with the internal cavity of the nozzle 2 and thus with the suction openings 15, 16, 17. During use, the vacuum cleaner generates suction at the connecting duct 3, causing air to be drawn in through the suction openings 15, 16, 17.

The tool 1 comprises four dirt-sweeping elements 4, each element comprising a strip of bristles. The dirt-sweeping elements 4 are secured to the base 6 of the nozzle 2 and are arranged into a W-shape. As a result, the dirt-sweeping elements 4 define three chevrons that are directed towards the sides 7,8 of the nozzle 2. More specifically, two of the chevrons are directed towards a first side 7 of the nozzle 2 and the third chevron, which is located between the other two chevrons, is directed towards the second opposite side 8 of the nozzle 2.

Each central suction opening 15 is located within a chevron formed by the dirt-sweeping elements 4. More particularly, each central suction opening 15 is located approximately at the centre of the chevron and is oriented so as to correspond with the shape of the chevron. As a result, each central suction opening 15 is spaced from the dirt-sweeping element 4.

The tool 1 is intended to be used primarily with the base 6 of the nozzle 2 facing the cleaning surface 30. The tool 1 is then swept from side to side, i.e. in directions normal to the sides 7,8 of the nozzle 2. As the tool 1 is swept sideways, dirt in the path of the suction openings 15,16 is drawn into the interior of the nozzle 2. From there, the dirt is carried to the vacuum cleaner via the connecting duct 3. Dirt that passes on either side of the suction openings 15,16 is collected by the dirt-sweeping elements 4. Fine dirt is typically held by the dirt-sweeping elements 4 until such time as the dirt is drawn into one of the suction openings 15,16, e.g. when the tool 1 is lifted, when the direction of travel is reversed, or should the user invert the tool 1 and agitate the dirt-sweeping elements 4. Coarse dirt, on the other hand, is typically guided by the dirt-sweeping elements 4, by virtue of their chevron arrangement, towards the central suction openings 15.

The bristles of each dirt-sweeping element 4 are densely packed and form a continuous curtain, i.e. there are no gaps in or through each dirt-sweeping element 4. A small gap exists between adjacent dirt-sweeping elements 4. However, the bristles are relatively soft and are crushed between the nozzle 2 and the cleaning surface 30 during normal use. As a result, the gaps between adjacent dirt-sweeping elements 4 are substantially closed. Consequently, during normal use of the tool 1, the dirt-sweeping elements 4 provide a substantially continuous seal between the nozzle 2 and the cleaning surface 30. More particularly, each pair of dirt-sweeping elements 4 creates a v-shaped seal around each central suction opening 15. As a consequence of the seal, a region of relatively low pressure is created within each chevron, which in turn leads to relatively high speeds for the airflow drawn into the central suction opening 15. More dirt is then entrained by the airflow and carried to the suction opening 15. If the bristles of each dirt-sweeping element 4 were formed as individual tufts that are spaced apart or have gaps there between, the pressure within each chevron would increase, the speed of the airflow would then decrease, and thus less dirt would be entrained by the airflow. Furthermore, if the bristles were relatively stiff, the bristles would fail to crush under the load applied during normal use and thus fail to provide an effective seal between the nozzle 2 and the cleaning surface 30. In this regard, it is to be noted that the bristles of a conventional tool are typically stiff and are intended to agitate the cleaning surface. By contrast, the dirt-sweeping elements 4 of the present tool 1 are not intended to agitate the cleaning surface 30. Instead, the dirt-sweeping elements 4 are intended to create a seal between the nozzle 2 and the cleaning surface 30, and guide dirt that has been pulled into a chevron towards a central suction opening 15.

The provision of soft bristles has at least two further advantages. First, marking of the cleaning surface 30 may be avoided or at the very least significantly reduced. As a result, the tool 1 may be used to clean relatively delicate surfaces. Second, even when the tool 1 is not held perfectly parallel with the cleaning surface 30, the bristles are nevertheless able to form a v-shape seal around each central suction opening 15. For example, the tool 1 may be held in such a way that the rear 10 of the nozzle 2 is raised slightly relative to the front 9. The downward force applied by the user on the tool 1 causes the bristles at the front 9 of the nozzle 2 to crush, thereby enabling the bristles at the rear 10 of the nozzle 2 to contact the cleaning surface 30 and form the desired seal. By contrast, if the bristles were relatively stiff, the bristles at the front 9 of the nozzle 2 would fail to crush under the downward force applied by the user and thus the bristles at the rear 10 of the nozzle 2 would fail to contact the cleaning surface 30. As a result, the bristles would provide poor sealing and thus the cleaning performance of the tool 1 would be adversely affected.

The central suction openings 15 are spaced from the dirt-sweeping elements 4. More particularly, each central suction opening 15 is spaced from the dirt-sweeping elements 4 by at least a distance corresponding to the length of the bristles. Consequently, when the bristles are crushed during use, the bristles do not extend into and restrict or otherwise block the central suction openings 15.

During use, it is possible that dirt may block one of the central suction openings 15. Should this occur, the corresponding edge suction opening 16 helps to unblock the central opening 15 be providing an airflow within the interior of the nozzle 2 that agitates and helps dislodge the trapped dirt. In seems somewhat counterintuitive that the provision of edge suction openings 16 in addition to the central suction openings 15 should improve dirt pickup. After all, the edge suction openings 16 will inevitably lead to a drop in suction at the central suction openings 15. Nevertheless, an improvement in dirt pickup was observed when the edge suction openings 16 were included.

Owing to its relatively shallow height, the tool 1 is able to access areas having a relatively small clearance. The tool 1 is therefore able to clean beneath or behind items that would otherwise prove impossible for a conventional cleaner head. Not only is the height of the nozzle 2 relatively shallow, but so too is the connecting duct 3. In particular, the duct 3 has a flattened profile, with the height being smaller than the width, and the duct 3 extends rearwards from the nozzle 2 along an axis that is parallel to the top 5 and base 6 of the nozzle 2. As a result, the tool 1 as a whole, rather than just the nozzle 2, is relatively shallow and may be pushed beneath or behind items having a small clearance. Although the height of the tool 1 is relatively shallow, the width and length of the nozzle 2 provide a relatively large area for sweeping across the cleaning surface 30.

Figure 5:
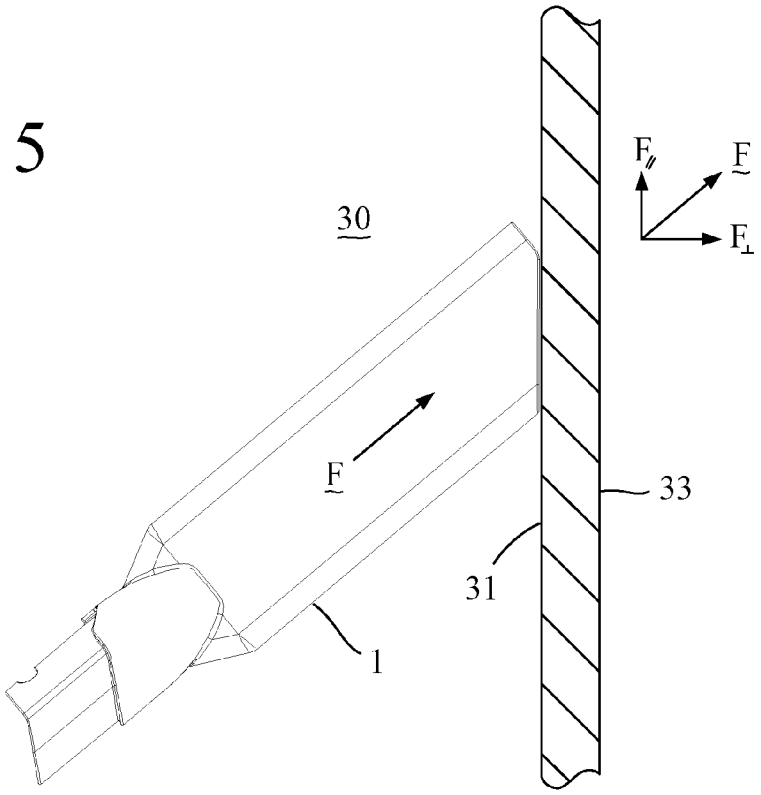
FIG. 5 illustrates the tool being used to clean along an edge.
Figure 6:
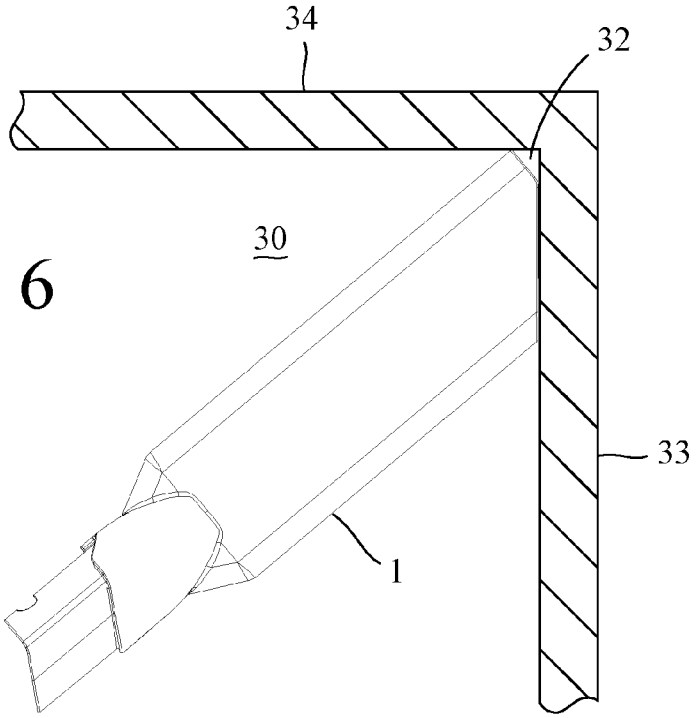
FIG. 6 illustrates the tool being used to clean at a corner.

Referring now to FIGS. 5 and 6, the tool 1 is well adapted at cleaning along an edge 31 or at a corner 32 of the cleaning surface 30.

FIG. 5 illustrates the tool 1 when used to clean along an edge 31 of the cleaning surface 30, e.g. such as that defined between the cleaning surface 30 and a wall 33. In order to clean along the edge 31, the chamfered section 11 of the nozzle 1 is brought into contact with the wall 33. Rather than sweeping the tool 1 directly sideways, which would pull the tool 1 away from the wall 33, the tool 1 is instead pushed in a generally forwards direction. Owing to the angle of the push force relative to the wall 33, the push force causes the tool 1 to slide sideways along the cleaning surface 30 whilst maintaining contact with the wall 33. The chamfered section 11 therefore has the advantage that the tool 1 can be made to slide along the cleaning surface 30 whilst maintaining contact with wall 33 simply by pushing the tool 1 forwards. If, for example, the front 9 of the nozzle 2 were square, the user would be required to pull the tool 1 sideways whilst simultaneously pushing the tool 1 forwards. The user would therefore be required to control two forces, i.e. a pull force and a push force. As a result, pulling the tool 1 along the wall 33 will typically feel more laboured. Additionally, the tool 1 is more likely to move along the wall 33 in fits and starts.

Since the tool 1 contacts the wall 33 along the chamfered section 11, the non-chamfered section 12 is spaced from the wall 33. The suction opening 17 in the non-chamfered section 12 then acts to draw in dirt from along the edge 31. If the suction opening 17 were moved to the chamfered section 11, the suction opening would be directly adjacent the wall 33. This might seem like a good idea since the suction opening would then be much closer to the edge 31 of the cleaning surface 30. However, the wall 33 would act to block the flow of air through the suction opening, and it is the flow of air that acts to pickup and entrain dirt. As a result, pickup of dirt along the edge 31 would actually worsen. By providing the suction opening 17 in the non-chamfered section 12, a gap is created between the suction opening 17 and the wall 33. This then ensures that a relatively good flow of air is drawn along the edge 31 and into the suction opening 17, resulting in good dirt pickup.

FIG. 6 illustrates the tool 1 when used to clean at a corner 32 of the cleaning surface 30. The tool 1 is pushed into the corner 32 such that the chamfered section 11 lies alongside one of the walls 33, whilst an edge of the non-chamfered section 12 contacts the other wall 34. The suction opening 17 in the non-chamfered section 12 is then spaced from the two walls 33,34. As a result, a relatively good flow of air is drawn down into the corner 32, resulting in good dirt pickup.

In addition to being swept from side-to-side over a surface 30, the tool 1 may be rotated through 90 degrees and used on its side to clean between narrow spaces. When used in this way, the edge suction openings 16 may be used to pick up dirt from surfaces that cannot otherwise be reached by the base 6 of the nozzle 2. For example, the tool 1 may be used to clean between two floor-standing items having a narrow separation. The tool 1 may be inserted sideways between the two items and pushed forwards and backwards over the floor. As a result, dirt on the floor may be picked up by the edge suction openings 16 adjacent the floor. Additionally, if the tool 1 is oriented such that non-chamfered section 12 is adjacent the floor, the suction opening 17 at the front 9 of the nozzle 2 may also act to pick up dirt.

Figure 7A:
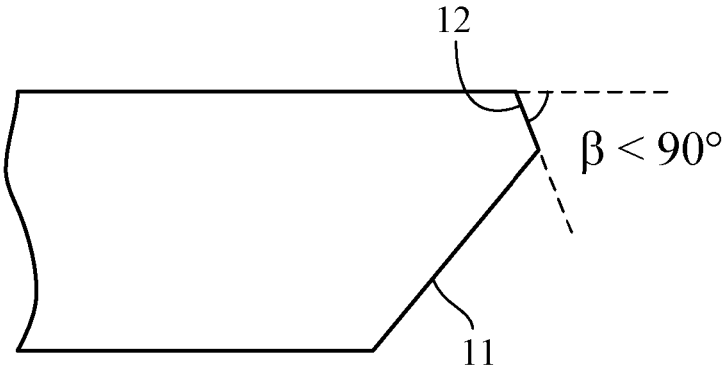
FIGS. 7(*a*), 7(*b*) and 7(*c*) illustrate embodiments of a tool in accordance with the present invention, in which the front of the tool comprises a chamfered section and a further section, and the further section is chamfered with an acute chamfer angle (FIG. 7(*a*)), non-chamfered (FIG. 7(*b*)), and chamfered with an obtuse chamfer angle (FIG. 7(*c*)).
Figure 7B:
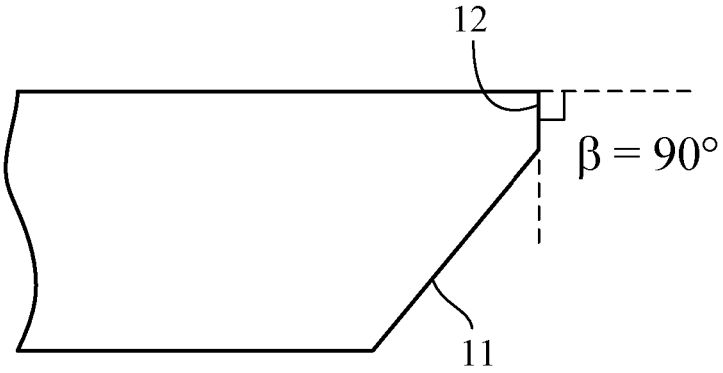
Figure 7C:
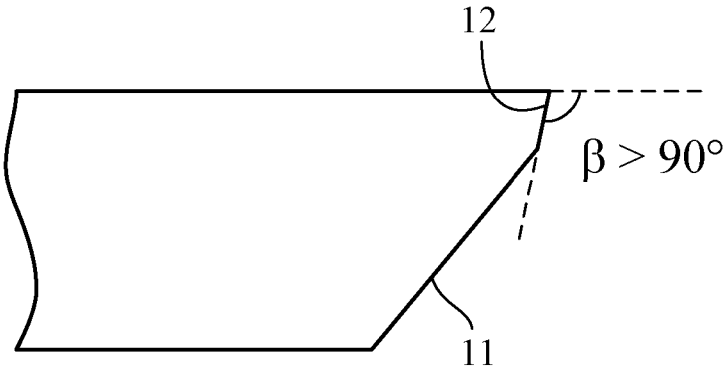

In the embodiment described above, the front 9 of the nozzle 2 comprises a chamfered section 11 and a non-chamfered section 12. Conceivably, however, the non-chamfered section 12 may also be chamfered. Accordingly, in a more general sense, the front 9 of the nozzle 2 may be said to have a chamfered section 11 and a further section 12, which may or may not be chamfered. As illustrated in FIGS. 7(*a*), 7(*b*) and 7(*c*), the further section 12 may have a chamfer angle, β, that is less than 90 degrees (FIG. 7(*a*)), equal to 90 degrees (i.e. non-chamfered) (FIG. 7(*b*)), or greater than 90 degrees (FIG. 7(*c*)). In all three embodiments, a gap is maintained between the wall 33 and the suction opening 17 during edge cleaning.

In the embodiment illustrated in FIGS. 1 to 6, the chamfered section 11 has a chamfer angle, α, of 50 degrees. As a result, the internal angle, γ, between the chamfered section 11 and the further section 12 is 140 degrees. As noted in the preceding paragraph, the chamfer angle, β, of the further section 12 need not be 90 degrees. Moreover, the chamfer angle, α, of the chamfered section 11 need not be 50 degrees. As a result, the internal angle, γ, between the two sections 11,12 may be less than or greater than 140 degrees. Nevertheless, for reasons that will now be explained, several of the advantages described above are achieved only when the internal angle, γ, is greater than 90 degrees and less than 180 degrees.

When the internal angle is 90 degrees, the further section 12 lies at a right angle to the chamfered section 11. Consequently, when the tool 1 is pushed into a corner 32 and the chamfered section 11 lies alongside one of the walls 33, the further section 12 will lie alongside the other wall 34. The other wall 34 will therefore cover and block the suction opening 17. As a result, the tool 1 will be relatively poor at picking up dirt trapped in corners.

When the internal angle is 180 degrees, the further section 12 lies in the same plane as that of the chamfered section 11. The front 9 of the nozzle 2 therefore appears to have a single bevelled section rather than two distinct sections. When the tool 1 is then used to clean along an edge 31 and the chamfered section 11 is brought into contact with the wall 33, the further section 12 will also contact the wall 33. The wall 33 will therefore cover and block the suction opening 17. As a result, the tool 1 will be relatively poor at picking up dirt along an edge 31.

As noted above, the internal angle, γ, between the chamfered section 11 and the further section 12 may be less than or greater than 140 degrees. However, there is an advantage in having an internal angle that does not differ markedly from 135 degrees. When the tool 1 is pushed into a corner 32 and the chamfered section 11 lies alongside one of the walls 33, the further section 12 will form an angle of 45 degrees with each of the two walls 33,34 if the internal angle between the two sections 11,12 is 135 degrees. As a result, the suction opening 17 is angled directly towards the corner 32. As the internal angle increasingly differs from 135 degrees, the suction opening 17 is turned from the corner 32 towards one of the two walls 33,34. Accordingly, relatively good dirt pickup at corners may be achieved by ensuring that the internal angle, γ, between the two sections 11,12 is between 120 and 150 degrees.

The chamfered section 11 is longer than the further section 12, which has at least two advantages. First, by having a comparatively longer chamfered section 11, the stability of the tool 1 is improved when pushing the tool 1 along a wall 33. In particular, the longer chamfered section 11 helps reduce rocking of the tool 1 relative to the wall 33. As a result, a user is better able to maintain contact between the tool 1 and the wall 33 as the tool 1 is pushed along the wall 33, thereby improving dirt pickup along the edge 31. Second, by having a comparatively shorter further section 12, the suction opening 17 at the front 9 of the nozzle 2 is kept relatively close to the edge 31 or corner 32 of the cleaning surface 30. As a result, relatively good dirt pickup is achieved along edges 31 and at corners 32.

When the chamfered section 11 contacts a wall 33 during edge cleaning and the tool 1 is pushed in a forwards direction, the force acting on the tool 1 can be resolved into two components: a first component acting in a direction parallel to the wall 33, and a second component acting in a direction perpendicular to the wall 33; see, for example, FIG. 5. The first component causes the tool 1 to slide along the wall 33, whilst the second component acts to pin the tool 1 against the wall 33. In the embodiment described above and illustrated in the Figures, the chamfered section 11 has a chamfer angle, α, of 50 degrees. As a result, the two components have approximately same magnitude. This then has the advantage that when the tool 1 is pushed forwards, the tool 1 slides along the wall 33 with relative ease whilst maintaining good contact with the wall 33. As the chamfer angle decreases, the magnitude of the first component decreases and the magnitude of the second component increases. Consequently, it becomes harder to push the tool 1 along the wall 33 owing to the increased friction that arises from the second component. Additionally, owing to the increased friction, the tool 1 is increasingly likely to move along the wall 33 in fits and starts. Conversely, as the chamfer angle increases, the magnitude of the first component increases and the magnitude of the second component decreases. It therefore becomes easier to push the tool 1 along the wall 33. However, it becomes increasingly difficult to maintain good contact between the chamfered section 11 and the wall 33 along the full length of the chamfered section 11. In particular, the tool 1 is increasingly likely to pivot at the trailing edge of the chamfered section 11, thus pulling the further section 12 and the suction opening 17 away from the edge 31. Accordingly, whilst it is not essential for the chamfered section 11 to have a chamfer angle of 50 degrees, there are advantages in having a chamfer angle of between 30 and 60 degrees.

In the embodiment described above, the chamfered section 11 is completely closed, i.e. there are no suction openings provided in the chamfered section 11. The front 9 of the tool 1 therefore comprises a single suction opening 17 provided in the further section 12 only. As explained above, the chamfered section 11 is intended to contact a wall 33 or the like during edge cleaning. Any suction openings in the chamfered section 12 are therefore unlikely to provide any significant benefit during edge cleaning since the wall 33 will only serve to cover and block the openings. On the other hand, when the tool 1 is not used for edge cleaning, any suction openings in the chamfered section 12 will only serve to decrease the suction at the suction openings 15,16 in the base 6 of the nozzle 2. Nevertheless, in spite of the apparent disadvantages, one could conceivably include a suction opening(s) in the chamfered section 12. For example, one could provide a single suction opening at the end of the chamfered section 12 adjacent the side 8 of the nozzle 2. Consequently, when the tool 1 is used on its side, and the tool 1 is oriented such that chamfered section 12 is adjacent the cleaning surface 30, the suction opening in the chamfered section 12 may help to pick up dirt. Nevertheless, in contrast to other tools in which the whole front of the nozzle is open, the chamfered section 12 continues to be at least partly closed.

In the embodiment illustrated in the Figures, each central suction opening 15 has an area that is approximately 5% that of the area delimited by a respective chevron. Suction openings of a different size are, of course, possible. As the size of each central suction opening 15 decreases, the suction at the opening 15 increases. As a result, the tool 1 is better able to pick up heavier dirt. However, smaller suction openings are then more likely to become blocked by dirt. Conversely, as the size of each central suction opening 15 increases, the likelihood of blockage decreases. However, the suction at the each opening 15 then decreases and thus dirt pick up is poorer. Additionally, as the size of each suction opening 15 increases, the suction over the length of the nozzle 2 is less well balanced. For example, since the connecting duct 3 is attached to the rear 10 of the nozzle 2, suction is generally greatest at the rearmost suction opening. As the suction openings 15 increase in size, more air is pulled in through the rearmost suction opening and thus less of the available suction power is provided at the foremost suction opening. As a result, dirt pickup at the front end of the tool 1 will worsen. Accordingly, whilst suction openings 15 of different sizes are possible, there are advantages to be had in ensuring that each suction opening has an area that is no more than 20% of the area delimited by the respective chevron.

In addition to the central suction openings 15, the tool 1 comprises edge suction openings 16. As noted above, the edge suction openings 16 have at least two advantages. First, should a central suction opening 15 become blocked, the airflow drawn in through the edge suction openings 16 helps to agitate and dislodge the dirt. Second, when using the tool 1 on its side, the edge suction openings 16 can be used to pick up dirt from surfaces that cannot otherwise be reached by the base 6 of the nozzle 2. Nevertheless, in spite of these advantages, the edge suction openings 16 may be omitted. This may be desirable, for example, if the suction provided by the vacuum cleaner is relatively weak. Alternatively, rather than having edge suction openings 16 that span both the base 6 and a side 7,8 of the nozzle 2, the edge suction openings 16 may be provided only in the side 7,8 of the nozzle 2. This would then have the advantage of reducing the size of the edge suction openings 16, which may be desirable if the suction provided by the vacuum cleaner is relatively weak. However, there is a further advantage in having edge suction openings 16 that span both the base 8 and a side 7,8 of the nozzle 2. When the tool 1 is used on its side, dirt could conceivably block the side part of the edge suction opening 16. However, since the edge suction opening 16 spans both the base 6 and a side 7,8 of the nozzle 2, there continues to be a flow of air through the base part of the edge suction opening 16. This airflow then helps to agitate and dislodge the dirt from the side part. Equally, when sweeping the base 6 of the nozzle 2 over the cleaning surface 30, should dirt block the base part of the edge suction opening 16, the flow of air through the side part helps to agitate and dislodge the dirt.

In the embodiment illustrated in the Figures, the tool 1 comprises four dirt-sweeping elements 4, each of which comprises a strip of bristles. The provision of four individual strips simplifies the manufacture and assembly of the tool 1. Conceivably, however, the tool 1 could comprise a single dirt-sweeping element 4 (e.g. a single strip of bristles) configured into a W-shape. This would then have the advantage that the small gaps between adjacent dirt-sweeping elements 4 may be avoided, thus improving the seal between the nozzle 2 and the cleaning surface 30. Furthermore, rather than bristles, each dirt-sweeping element may comprise alternative means for forming a seal between the nozzle 2 and the cleaning surface 30. For example, each dirt-sweeping element 4 could comprise a strip of elastomeric foam, perhaps with a low-friction coating such as PTFE.

The invention claimed is:

1. A tool for a vacuum cleaner comprising a duct for attachment to the vacuum cleaner, a nozzle and one or more dirt-sweeping elements, wherein the nozzle comprises two sides that extend between a front and a rear of the nozzle, the duct is attached to the rear of the nozzle, the dirt-sweeping elements are secured to a base of the nozzle and are arranged into at least two chevrons oriented in opposite directions towards the sides of the nozzle, at least two suction openings are provided in the base of the nozzle, each suction opening is located within a respective chevron, and the area of each suction opening is no more than 20% of the area delimited by the respective chevron.

2. The tool of claim 1, wherein each dirt-sweeping element forms a continuous curtain.

3. The tool of claim 1, wherein each suction opening is spaced from the dirt-sweeping elements.

4. The tool of claim 3, wherein the dirt-sweeping elements comprise bristles, and each suction opening is spaced from the dirt-sweeping elements by at least a distance corresponding to the length of the bristles.

5. The tool of claim 1, wherein the suction openings are triangular in shape.

6. The tool of claim 1, wherein one or more further suction openings are provided in at least one side of the nozzle.

7. The tool of claim 6, wherein each further suction opening is provided at an edge of the nozzle between the base and a side of the nozzle such that each further suction opening is provided partly in the base and partly in the side of the nozzle.

8. The tool of claim 6, wherein each suction opening has a respective further suction opening.

9. The tool of claim 1, wherein the front of the nozzle is chamfered.

10. The tool of claim 9, wherein the front of the nozzle comprises a chamfered section and a further section, the chamfered section is closed and a suction opening is provided in the further section.

11. The tool of claim 1, wherein the height of the nozzle is smaller than both the width and length of the nozzle.

12. The tool of claim 1, wherein the duct extends rearwards from the nozzle along an axis parallel to the base of the nozzle.

13. The tool of claim 1, wherein the height of the duct is smaller than the width of the duct.

14. A tool for a vacuum cleaner comprising a duct for attachment to the vacuum cleaner, a nozzle and one of more dirt-sweeping elements, wherein the nozzle comprises two sides that extend between a front and a rear of the nozzle, the height of the nozzle is smaller than both the width and length of the nozzle, the length of the nozzle is greater than the width of the nozzle, the duct extends rearwards from the nozzle, the dirt-sweeping elements are secured to a base of the nozzle and are arranged into at least two chevrons oriented in opposite directions towards the sides of the nozzle, and at least two suction openings are provided in the base of the nozzle, each suction opening being located within a chevron.

15. The tool of claim 14, wherein each suction opening is spaced from the dirt-sweeping elements.

16. The tool of claim 15, wherein the dirt-sweeping elements comprise bristles, and each suction opening is spaced from the dirt-sweeping elements by at least a distance corresponding to the length of the bristles.

17. The tool of claim 14, wherein the suction openings are triangular in shape.

18. The tool of claim 14, wherein one or more further suction openings are provided in at least one side of the nozzle.

19. A tool for a vacuum cleaner comprising a duct for attachment to the vacuum cleaner, a nozzle and one of more dirt-sweeping elements, wherein the nozzle comprises two sides that extend between a front and a rear of the nozzle, the duct is attached to the rear of the nozzle, the height of the nozzle is smaller than both the width and length of the nozzle, the dirt-sweeping elements are secured to a base of the nozzle and are arranged into at least two chevrons oriented in opposite directions towards the sides of the nozzle, at least two suction openings are provided in the base of the nozzle, each suction opening being located within a chevron, and one or more further suction openings are provided in at least one of the sides of the nozzle.

20. The tool of claim 19, wherein each further suction opening is provided at an edge of the nozzle between the base and a side of the nozzle such that each further suction opening is provided partly in the base and partly in the side of the nozzle.

21. The tool of claim 19, wherein each suction opening is spaced from the dirt-sweeping elements.

22. The tool of claim 21, wherein the dirt-sweeping elements comprise bristles, and each suction opening is spaced from the dirt-sweeping elements by at least a distance corresponding to the length of the bristles.

23. The tool of claim 19, wherein the suction openings are triangular in shape.

24. A tool for a vacuum cleaner comprising a duct for attachment to the vacuum cleaner, a nozzle and one or more dirt-sweeping elements, wherein a base of the nozzle is flat, the dirt-sweeping elements are secured to the base of the nozzle and are arranged into at least two chevrons oriented in opposite directions towards the sides of the nozzle, at least two suction openings are provided in the base of the nozzle, each suction opening is located within a chevron, the dirt-sweeping elements comprise bristles, and each suction opening is spaced from the dirt-sweeping elements by at least a distance corresponding to the length of the bristles.

25. The tool of claim 24, wherein the suction openings are triangular in shape.

26. The tool of claim 24, wherein one or more further suction openings are provided in at least one side of the nozzle.

27. The tool of claim 26, wherein each further suction opening is provided at an edge of the nozzle between the base and a side of the nozzle such that each further suction opening is provided partly in the base and partly in the side of the nozzle.

28. The tool of claim 26, wherein each suction opening has a respective further suction opening.

29. A tool for a vacuum cleaner comprising a duct for attachment to the vacuum cleaner, a nozzle and one or more dirt-sweeping elements, wherein the front of the nozzle is chamfered, the dirt-sweeping elements are secured to a base of the nozzle and are arranged into at least two chevrons oriented in opposite directions towards the sides of the nozzle, and at least two suction openings are provided in the base of the nozzle, each suction opening being located within a chevron.

30. The tool of claim 29, wherein the front of the nozzle comprises a chamfered section and a further section, the chamfered section is closed and a suction opening is provided in the further section.

* * * * *